United States Patent [19]

Williams, Jr. et al.

[11] Patent Number: 4,504,281

[45] Date of Patent: Mar. 12, 1985

[54] ODORANT INJECTION APPARATUS

[75] Inventors: Benjamin J. Williams, Jr., Houston, Tex.; Robert G. Hodge, Petal, Miss.

[73] Assignee: Allied Corporation, Morris Township, Morris County, N.J.

[21] Appl. No.: 523,917

[22] Filed: Aug. 16, 1983

Related U.S. Application Data

[63] Continuation of Ser. No. 339,252, Jan. 31, 1982, abandoned.

[51] Int. Cl.[3] ..... C10L 10/00

[52] U.S. Cl. ..... 48/195; 44/2

[58] Field of Search ..... 48/195, 192; 44/2, 59; 222/154, 155, 129, 135

[56] References Cited

U.S. PATENT DOCUMENTS

| | | | |
|---|---|---|---|
| 1,973,677 | 9/1934 | Woodford | 222/135 |
| 2,935,391 | 5/1960 | Evans et al. | 48/195 |
| 3,907,515 | 9/1975 | Mulliner | 44/2 |

OTHER PUBLICATIONS

R. H. Perry, "Chemical Engineers Handbook", 5th Ed., 1973, pp. 22–59, 67–68, 92–93.

*Primary Examiner*—Peter Kratz

*Attorney, Agent, or Firm*—Paul Yee; Ernest D. Buff; Roy H. Massengill

[57] ABSTRACT

A closed and environmentally safe odorant injection apparatus comprises a pressured gas supply, preferably nitrogen, an odorant storage tank, a panel which contains a level pot and sight glass and manually actuated, pneumatically operated switches for drawing a measured portion of odorant and injecting the measured portion into LPG being loaded into a tank truck.

6 Claims, 2 Drawing Figures

ODORANT INJECTION APPARATUS

This application is a continuation of application Ser. No. 339,252, filed Jan. 31, 1982 now abandoned.

BACKGROUND OF THE INVENTION

The present invention involves an odorant injection system for a transportation loading dock handling liquified petroleum gas (LPG). More specifically, the system of the present invention uses a pressured gas valving system to inject a measured portion of odorant into the LPG line near the loading arm of a transportation loading dock.

Liquified petroleum gas is practically odorless and highly flammable in an air mixture. It is desirable, if not mandatory, to odorize the LPG to detect leaks in storage vessels, furnaces or stoves which use the LPG. Accordingly, when LPG is transferred from bulk storage to tank trucks, for example, an odorant is added to the LPG. It has long been recognized that an effective amount of odorant is an amount sufficient to warn of a leak but not much more. Over-odorization is not desirable because the odor can be present even absent a leak. For example, a pilot flame may not burn all the odorant. The apparatus of the present invention provides an economical, easy to use and accurate system which provides an accurate record that the tank truck has odorant added to the LPG.

U.S. Pat. No. 2,935,391 discloses an apparatus for odorizing a product. The apparatus includes a supply drum, a pressure cylinder, a stench pot and a vent tank. The vent tank is used to absorb the mercaptan odorant.

U.S. Pat. No. 3,216,434 discloses an additive injection system. The system includes an electrical system which injects a predetermined amount of additive and a printing head which records the amount of additive and the number of injections on a ticket.

U.S. Pat. No. 3,235,348 discloses a system for adding ethyl mercaptan into natural gas or liquified petroleum gas. The system uses a positive displacement metering pump and dual buffering chambers containing lube oil and mercury to cushion the action of the pump.

U.S. Pat. No. 3,907,515 discloses an apparatus for odorizing liquid natural gas. Since LNG is handled at very low temperatures this patent discloses a complex electrical control circuit with automatic shutdown features to add an odorant at very cold (cryogenic) temperatures.

Other patents which disclose the injection of odorants are U.S. Pat. Nos. 1,930,848; 2,098,626; 2,261,590 and 4,025,315.

SUMMARY OF THE INVENTION

The present invention involves a mercaptan injection system for odorizing LPG at the loading dock, specifically a tank truck dock. More specifically, the apparatus comprises a storage tank for the odorant, tanks of pressured gas and an injection panel which contains a level pot for measuring a portion of odorant, a manually actuated-pneumatically operated switch for filling the level pot with the desired amount of odorant, a second manually actuated-pneumatically operated switch for injecting the odorant into the loading arm loading the truck, and a recorder for making a record of the injection of the odorant into the truck. The panel may contain switches to supply at least two different loading arms such as an arm on either side of a loading island where the panel is located.

DETAILED DESCRIPTION OF THE PREFERRED EMBODIMENT

Figure 1:
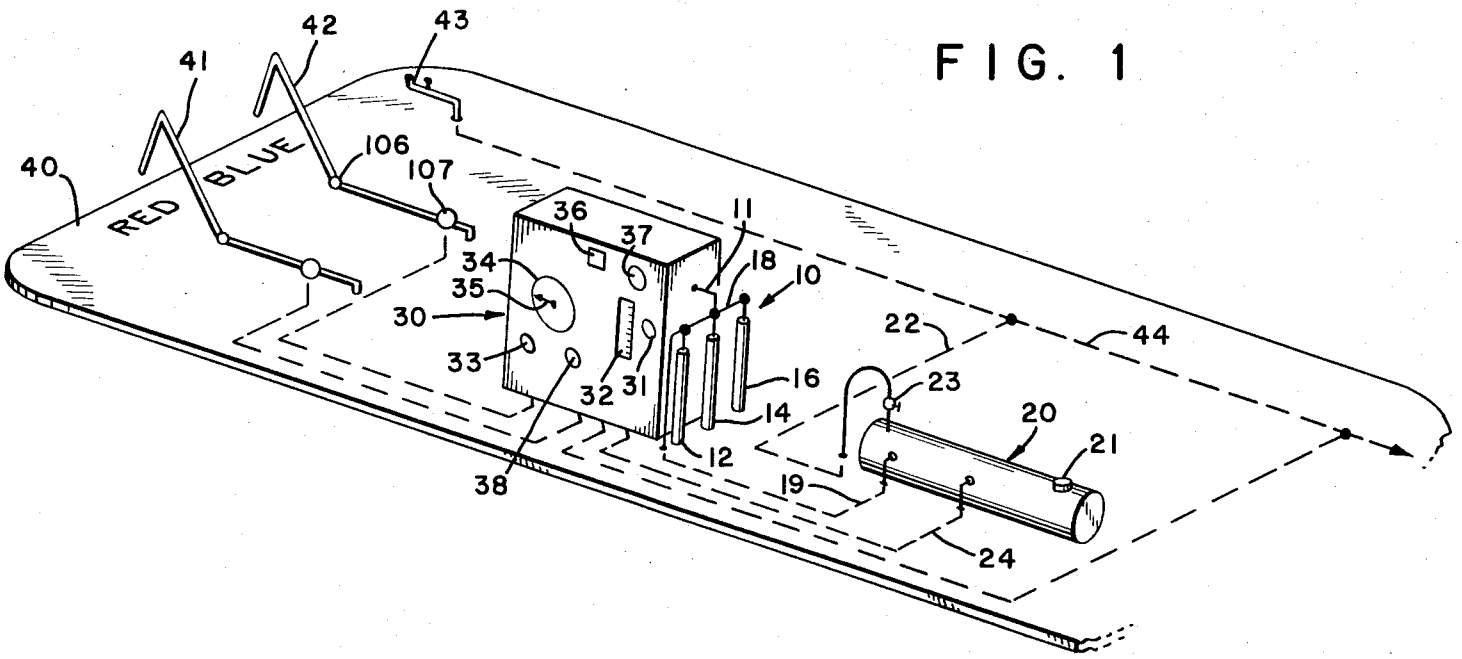
FIG. 1 is a schematic representation of the system of the present invention for injecting odorant into a two loading arm tank truck loading dock.

Referring to FIG. 1, the odorant injection system or apparatus of the present invention comprises a pressured gas supply 10, an odorant storage tank 20 and a panel 30 which contains the controls for the system. Preferably, the system is used on an island 40 of a truck loading dock. A tank truck loads either from one side of island 40 using loading arm 41 painted red or from the other side of island 40 using the loading arm 42 painted blue. Assuming for the purpose of illustration that a truck loads LPG, propane or the like on the side of island 40 using loading arm 42, the operator of the truck will connect loading arm 42 to the inlet pipe of the truck. A vapor hose is connected from the vent of the truck to connection 43 on the island 40 which is connected to a vapor return line 44 or a line connected to a flare in a remote location. After the lines and hoses are connected, the LPG is ready to be pumped into the tank truck.

Before pumping of the LPG into the tank truck, the operator uses the apparatus of the present invention to inject an odorant. The apparatus provides a safe, closed system to measure the odorant, inject the odorant into the LPG and record that the odorant has been injected through the loading arm 42.

The apparatus of the present invention uses a pressured gas, preferably nitrogen, to provide the closed system. Nitrogen is supplied by a plurality of bottles 12, 14 and 16 which are connected to a manifold 18. The source of nitrogen is maintained by replacing individual bottles of nitrogen as they are depleted. A line 11 provides nitrogen to the panel 30 for actuating the controls, as will be described hereinafter, and a line 19 provides nitrogen to the top of the odorant storage tank 20 to maintain the odorant under pressure.

The odorant storage tank 20 is filled preferably with ethyl mercaptan, a known odorant for LPG. A fill connection 21 on tank 20 provides for a hose to be connected to the supply. A vent line 22 is opened by means of valve 23 during the filling of storage tank 20. The vent line 22 is connected to line 44. Since tank 20 is maintained with the blanket of nitrogen, even during filling of tank 20 only small amounts of the odorant is vented. In operation the odorant from tank 20 is supplied by line 24 to the panel 30, as will be described hereinafter.

In operating the apparatus of the present invention, the operator of the truck goes to the panel 30. The operator pushes button 31 and watches level glass 32 which is calibrated in thousands of gallons. The operator knows the amount of LPG in thousands of gallons being loaded into the truck. When the liquid in the level glass 32 reaches the thousands of gallons mark being loaded, button 31 is released. The operator then pushes button 33, which is painted blue and corresponds to the color on the loading arm 42 which is connected to the truck, to inject the odorant. A recorder 34 on the panel has a pen 35 which marks the injection of the odorant. The recorder 34 may be a twenty-four hour recorder and marks the time and loading arm used to inject the odorant. A switch 36 on panel 30 turns on a light 37 for the operator to see during darkness. A second button 38 painted red actuates the injection of odorant through loading arm 41.

Figure 2:
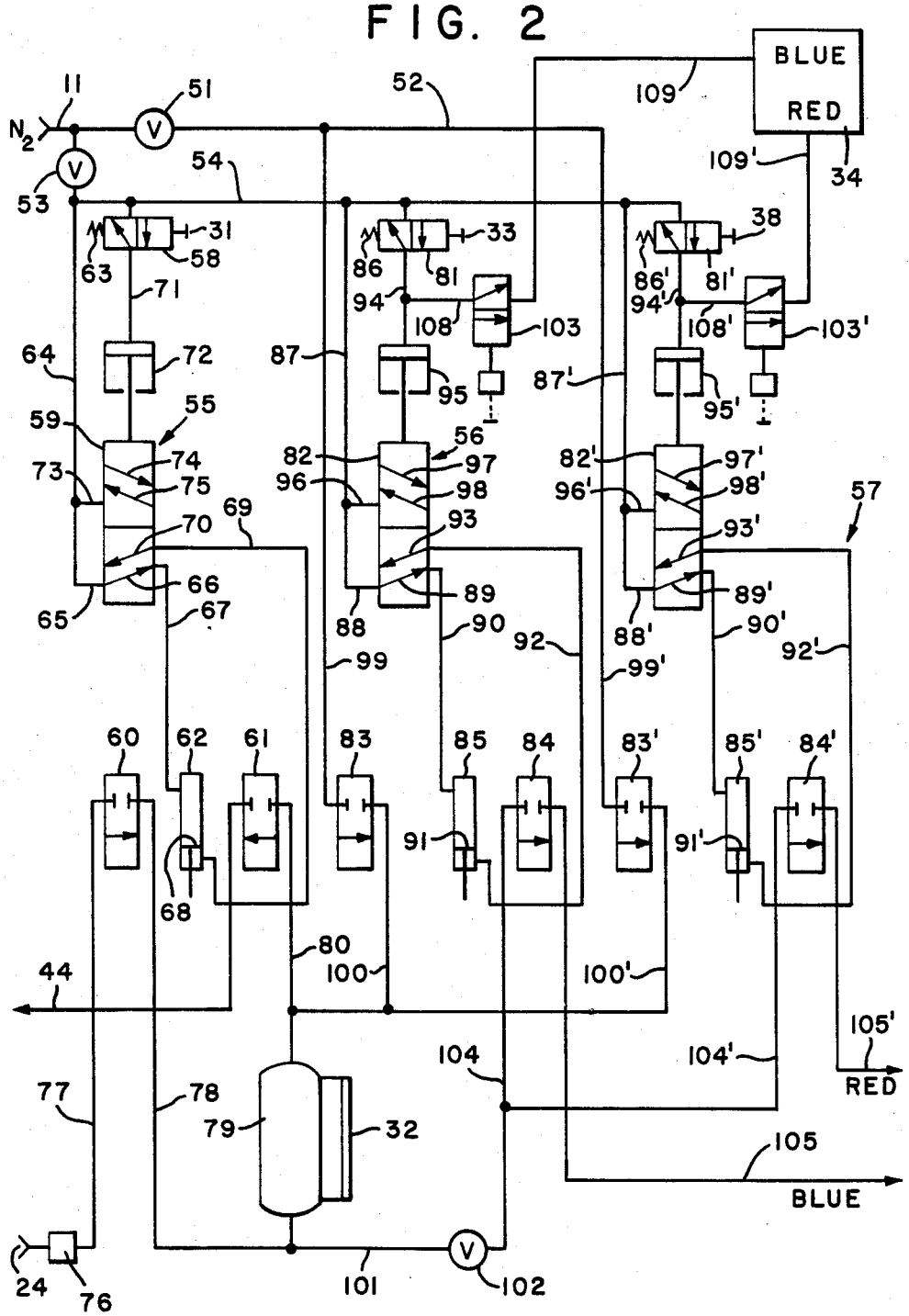
FIG. 2 is a schematic representation of the manually operated-pneumatically operated switches employed in the operation of the apparatus of the present invention.

Referring to FIG. 2, the control of the system of the present invention is illustrated in more detail. The pressured gas, nitrogen, is used as the pneumatic fluid to operate the controls which are all housed in panel 30. Nitrogen is introduced by line 11. The pressure of the nitrogen is above 35 atmospheres (about 525 psig) and is introduced through pressure reduction valve and controller 51 to line 52 at a pressure between about 2 to 4 atmospheres (about 40 to 70 psig). A second and independent pressure reduction valve and controller 53 is in line 54 to reduce the nitrogen pressure in line 54 to about 2 to 3 atmospheres (about 40 to 60 psig). The control of the system is through three manual switch means 55, 56, and 57. Switch means 55 is comprised of a manually actuated pressure slide valve 58, a four way slide valve 59 and two ball valves 60 and 61 which are simultaneously actuated by actuator 62. Switch means 55 is schematically shown in FIG. 2 in its normal position. Slide valve 58 in its normal position is closed by means of spring 63. Nitrogen from line 54 passes through lines 64 and 65 and passes through opening 66 in four way slide valve 59. The nitrogen then passes through line 67 to the top chamber of actuator 62 which maintains the piston 68 as shown. The lower chamber of actuator 63 is connected to line 69 which in the normal position vents to atmosphere through opening 70 in four way slide valve 59.

The operator manually actuates switch means 55 by pressing button 31 on panel 30. By pressing button 31 the slide valve 58 is then opened and nitrogen from line 54 flows through valve 58 and line 71 to actuator 72. Actuator 72 changes the position of four way valve 59 so that nitrogen from line 64 passes through line 73, then through opening 74 in valve 59 and then into line 69. The nitrogen forces piston 68 up which in turn opens valves 60 and 61 simultaneously. Nitrogen in the upper chamber flows out line 67 and through opening 75 in four-way valve 59 to the atmosphere when valves 60 and 61 are opened, the odorant flows into panel 30 by line 24 and passes through a filter 76, then through line 77 and through open valve 60. The odorant then flows through line 78 to a level pot 79 inside panel 30 with sight glass 32 which has a calibration of level in terms of volume of LPG to be introduced to the tank truck. The nitrogen blanket is vented through line 80 and open valve 61 to vent line 44. Thus, the operator by pressing button 31 draws a measured portion of odorant into the level pot 79 in a closed system.

Switch means 56 and 57 are identical in components and operation. Accordingly, reference numbers with respect to switch means 57 will use the same reference number as used in describing switch means 56 except will have a prime (′). Switch means 56 is comprised of a manually operated slide valve 81, a four way slide valve 82 and two ball valves 83 and 84 which are simultaneously actuated by actuator 85. Switch means 56 and 57 are schematically shown in FIG. 2 in their normal position. Valve 81 in its normal position is closed by means of spring 86. Nitrogen from line 54 passes through lines 87 and 88 and passes through opening 89 in four way valve 82. The nitrogen then passes through line 90 to the top chamber of actuator 85 which maintains the piston 91 as shown. The lower chamber of actuator 85 is connected to line 92 which in the normal position vents to atmosphere through opening 93 in four way valve 82.

The operator manually operates switch means 56 by pressing button 33 on panel 30. This is for blue loading arm 42 and both the loading arm 42 and button 33 are painted blue. By pressing button 33 the ball valve 81 is opened and nitrogen from line 54 flows through valve 81 and line 94 to actuator 95. Actuator 95 changes the position of four way valve 82 so that nitrogen from line 87 passes through line 96, then through opening 97 in valve 82 and then into line 92. The nitrogen forces piston 91 up which in turn opens valves 83 and 84 simultaneously. Nitrogen in the upper chamber flows out line 90 and through opening 98 in four way valve 82 to the atmosphere. When ball valves 83 and 84 are opened, nitrogen flows from line 52 through line 99 and open valve 83. The nitrogen then flows through line 100 into the top of level pot 79 forcing the measured portion of odorant out line 101. In line 101 is a fluid flow switch 102 which actuates a solenoid operated valve 103, which will be described in detail hereinafter. The odorant continues to flow through line 104 and through open valve 84 to line 105. The odorant line 105 is attached to the LPG line for loading arm 42. The odorant line 105′ is attached to the LPG line for loading arm 41. As shown in FIG. 1, a valve 106 is between loading arm 42 and the mixing connection 107 where odorant line 105 is attached to the LPG line. Valve 106 must be open for odorant or LPG to flow and is opened only after the proper connections with the tank truck have been completed. Thus, during the filling of the truck the addition of the measured amount of odorant is easily and safely added to the LPG.

The flow of odorant through line 101 activates a fluid flow switch 102. This switch 102 in turn actuates solenoid valve 103 which moves from a closed position (shown in FIG. 2) to an open position. Nitrogen in line 94 flows through line 108 and then open valve 103. The nitrogen then flows through line 109 to activate a pen in recorder 34. Recorder 34 is preferably a recorder having a twenty-four hour circular record sheet and two separate pens. The pens are filled with blue and red ink to correspond to the colors of the loading arms. The nitrogen flowing into line 109 causes the blue pen to move from a normal position to a second position on the record sheet. Thus, a record of the time, the flow of odorant and the loading arm used is made.

The apparatus of the present invention provides a closed and safe system for injecting odorant, preferably ethyl mercaptan, into LPG as LPG is pumped into tank trucks. The odorant is maintained under a blanket of pressured gas, preferably nitrogen, so that the odorant does not escape or come into contact with the operator. The system of the present invention eliminates the electrical systems of known injection systems which are a hazard in an area where LPG is handled. The only electrical connections in the present invention are to the switch 36 for the light 37 and the connection from flow switch 102 to the solenoid operated valve 103. Switch 36, light 37 and the electrical connection to the solenoid are all known explosion proof pieces of equipment. The apparatus of the present invention further makes a record that odorant was added. The recorder is mechanically wound, similarly as a clock, and each days filling of tank trucks is permanently recorded. The use of stainless steel tubing, level pot, valves and other equipment in contact with the ethyl mercaptan together with Teflon seals provides an environmentally-safe stench system.

We claim:

1. An apparatus for odorizing LPG, comprising:

(a) a pressurization means for supplying a pressurized gas;

(b) tank for storing odorant under gas pressure directed from said pressurization means, said tank means having an interconnecting pipeline between said pressurization means and the top of said tank means to pressurize said odorant with said pressurized gas and provide an isolating blanket of said gas on top of said odorant, which limits the amount of odorant vented therefrom;

(c) level pot means for measuring and holding a portion of odorant delivered thereto through a pipeline interconnecting said tank means to the bottom of said level pot means, said level pot means having an interconnecting pipeline between said pressurization means and the top of said level pot means to provide an isolating blanket of said gas on top of said odorant that limits the amount of odorant vented therefrom, further having an interconnecting pipeline from the top of said level pot means to a vent pipeline connected directly to a vapor return line, and having a pipeline interconnecting the bottom of said level pot means to a LPG loading pipeline;

(d) first switch means for drawing a measured portion of said odorant from said tank means into said level pot means, which comprises:

a first valve located in said pipeline between said tank means and said level pot means, a second valve located in said pipeline between the top of said level pot means and said vent pipeline, a first manually operated switching means connected to selectively direct gas flow from said pressurization means to operate a first pneumatic, valve actuator, a first four-way valve, which is actuated by said first pneumatic actuator, and which is connected to direct gas flow from said pressurization means, and a second pneumatic, valve actuator, which is connected to receive a gas flow directed from said first four-way valve and which is configured to simultaneously actuate said first and second valves to maintain said gas blanket in said level pot means during the filling thereof with odorant, thereby limiting the venting of odorant therefrom; and (e) second switch means for supplying said measured portion of odorant from said level pot means into said LPG loading pipeline, which comprises:

a third valve located in said pipeline between said pressurization means and said level pot means, a fourth valve located in said pipeline between the bottom of said level pot means and said LPG loading pipeline, a second manually operated switching means connected to said pressurization means for flowing gas therefrom to operate a third pneumatic, valve actuator, a second four-way valve, which is actuated by said third pneumatic actuator and which is connected to direct gas flow from said pressurization means, and a fourth pneumatic, valve actuator, which is connected to receive a gas flow directed from said second four-way valve and which is configured to simultaneously actuate said third and fourth valves, thereby flowing odorant from said level pot means to said LPG loading pipeline.

2. An apparatus as recited in claim 1, further comprising:

(a) a recorder;

(b) fluid flow switch means located in said pipeline between said level pot means and said LPG loading pipeline, (c) a solenoid operated valve, which is actuated by said fluid flow switch means and which is connected to direct a gas flow from said pressurization means to activate said recorder to make a mark thereon when said measured portion of odorant passes from said level pot means into said LPG loading pipeline.

3. An apparatus as recited in claim 2, wherein said solenoid operated valve is connected to receive gas flow from said pressurization means through said second manually operated switching means to activate said recorder.

4. An apparatus as recited in claim 3, wherein said recorder is a 24-hour-recording pen recorder.

5. An apparatus as recited in claim 1, further comprising at least one other of said second switch means for injecting said measured portion of odorant from said level pot means into respective LPG loading pipelines connected thereto, each of said other second switch means comprising:

(a) a fifth valve located in a pipeline between said pressurization means and the top of said level pot means;

(b) a sixth valve located in a pipeline between the bottom of said level pot means and a LPG loading pipeline;

(c) a third manually operated switching means connected to direct gas flow from said pressurization means to operate a fifth pneumatic, valve actuator;

(d) a third four-way valve, which is actuated by said fifth pneumatic actuator and which is connected to direct gas flow received from said pressurization means, and (e) a sixth pneumatic, valve actuator, which is connected to receive a gas flow from said third four-way valve and which is configured to simultaneously actuate said fifth and sixth valves, thereby flowing odorant from said level pot means to said respective LPG loading pipelines.

6. An apparatus as recited in claim 5, further comprising:

(a) a recorder with at least two pens;

(b) fluid flow switch means located in said pipeline between said level pot means and said respective LPG loading lines;

(c) a first solenoid operated valve, which is actuated by said fluid flow switch means, is connected to receive gas flow directed from said pressurization means by said second manually operated switching means and which is connected to direct the gas flow to activate said first recorder pen to make a mark thereon when said measured portion of odorant passes from said level pot means into a first LPG loading pipeline; and (d) a second solenoid operated valve, which is actuated by said fluid flow switch means, is connected to receive gas flow directed from said pressurization means by said third manually operated switching means and which is connected to direct the gas flow to activate said second recorder pen to make a mark thereon when said measured portion of odorant passes from said level pot means into a second LPG loading pipeline.

* * * * *